United States Patent [19]

Miyazaki

[11] Patent Number: 4,982,331

[45] Date of Patent: Jan. 1, 1991

[54] FUEL INJECTOR CONTROL APPARATUS

[75] Inventor: Masaaki Miyazaki, Himeji City, Japan

[73] Assignee: Mitsubishi Denki Kabushiki Kaisha, Tokyo, Japan

[21] Appl. No.: 299,175

[22] Filed: Jan. 19, 1989

[30] Foreign Application Priority Data

Jan. 25, 1988 [JP] Japan ..... 63-14958
Jan. 25, 1988 [JP] Japan ..... 63-14959

[51] Int. Cl.[5] ..... F02M 51/00; F02D 41/04

[52] U.S. Cl. ..... 364/431.04; 123/357; 123/497

[58] Field of Search ..... 123/357, 381, 497, 499, 123/500–503; 364/431.04, 431.05, 431.06

[56] References Cited

U.S. PATENT DOCUMENTS 4,174,694 11/1979 Wessel et al. ..... 123/381
4,252,097 2/1981 Hartford et al. ..... 123/381
4,284,053 8/1981 Merrick ..... 123/497
4,494,511 1/1985 Ito et al. ..... 123/463
4,558,679 12/1985 Koyanagi ..... 123/502
4,693,222 9/1987 Itou et al. ..... 123/497
4,791,905 12/1988 Furuta et al. ..... 123/497
4,836,166 6/1989 Wietelmann ..... 123/381

*Primary Examiner*—Felix D. Gruber
*Attorney, Agent, or Firm*—Sughrue, Mion, Zinn, Macpeak and Seas

[57] ABSTRACT

A control apparatus for a fuel injector has a microcomputer which calculates a basic pulse width of pulses to be applied to a fuel injector. When the voltage of a battery which powers a fuel pump and the fuel temperature fall below levels which cause the discharge pressure of the fuel pump to drop below a prescribed pressure, the microcomputer corrects the basic pulse width by lengthening it to compensate for the drop in fuel pressure. Pulses having the corrected pulse width are applied to the fuel injector.

4 Claims, 6 Drawing Sheets

FUEL INJECTOR CONTROL APPARATUS

BACKGROUND OF THE INVENTION

This invention relates to a control apparatus for a fuel injector of an automotive engine. More particularly, it relates to a control apparatus which can properly control the supply of fuel to a fuel injector even when there are variations in the discharge pressure of a fuel pump which supplies fuel to the fuel injector.

A controller for an electronic fuel injection valve (hereinbelow referred to as a fuel injector) of an automobile engine turns the fuel injector on and off by the application thereto of electronic pulses having a prescribed pulse width. In a conventional controller the pulse width is determined on the basis of the engine rotational speed, the intake manifold pressure, and other parameters of engine operation.

Recently, in-tank fuel supply systems which have a turbine-type pump housed inside a fuel tank are becoming common since they reduce the noise which is generated by the fuel pump. The fuel pump is powered by the battery of the automobile. When the battery voltage falls, the discharge pressure of a turbine-type fuel pump correspondingly decreases.

The discharge pressure of a fuel pump is also affected by the temperature of the fuel. Namely, a decrease in the fuel temperature causes an increase in the viscosity of the fuel, which causes the discharge pressure of the fuel pump to drop. Accordingly, when the battery voltage and the fuel temperature decrease to certain values, the discharge pressure of the fuel pump will fall below a level at which the fuel pressure can not be maintained at its normal level, such as 2.55 $kg/cm^2$.

In a conventional fuel injector controller, the pulse width of the pulses which are applied to the fuel injector are not corrected for the decrease in the fuel pressure resulting from a decrease in the battery voltage or the fuel temperature. Therefore, at times when the fuel pressure falls below its normal level due to a decrease in the battery voltage or the fuel temperature, such as when the engine is first started, the proper amount of fuel can not be supplied to the engine by the fuel injector.

SUMMARY OF THE INVENTION

Accordingly, it is an object of the present invention to provide a control apparatus for a fuel injector which can compensate for decreases in the discharge pressure of a fuel pump when the battery voltage is low and correctly control the supply of fuel to an engine.

It is another object of the present invention to provide a control apparatus for a fuel injector which can compensate for decreases in the discharge pressure of a fuel pump when the fuel temperature is low.

A control apparatus for a fuel injector in accordance with the present invention calculates a basic pulse width on the basis of engine operating parameters. If the battery voltage or the fuel temperature falls below a level which causes the discharge pressure of a fuel pump to fall below a prescribed level, the basic pulse width is corrected by lengthening in order to compensate for the decrease in fuel pressure. Pulses having the corrected pulse width are then applied to the fuel injector.

As a result, even at times when the battery voltage and the fuel temperature tend to be low, such as when the engine is started, the proper amount of fuel can be supplied to the fuel injector and accurate fuel supply can be carried out.

A control apparatus for a fuel injector for an engine according to the present invention comprises first sensing means for sensing operating parameters of an engine, calculating means responsive to the sensing means for calculating a basic pulse width of pulses to be applied to the fuel injector, second sensing means for sensing one or more fuel pump operating parameters including the voltage of a battery which powers the fuel pump, correcting means responsive to the second sensing means, for lengthening the basic pulse width and producing a corrected pulse width when the one or more fuel pump operating parameters which are detected by the second sensing means fall below a level which causes the discharge pressure of the fuel pump to fall below a prescribed level, and means for applying pulses having the corrected pulse width to the fuel injector.

In a preferred embodiment, the calculating means, the correcting means, and the means for applying pulses to the fuel injector are in the form of a microcomputer.

In one form of the present invention, the one or more fuel pump operating parameters comprise the battery voltage. In another form of the invention, the fuel pump operating parameters comprise the battery voltage and the fuel temperature.

The present invention also resides in a method for controlling a fuel injector of an engine. The method comprises calculating a basic pulse width of pulses to be applied to the fuel injector based on engine operating parameters, sensing one or more fuel pump operating parameters which influence the discharge pressure of a fuel pump which supplies fuel to the fuel injector, the one or more parameters including the voltage of a battery which powers the fuel pump, lengthening the basic pulse width when the value of the one or more fuel pump operating parameters fall below a level at which the discharge pressure of the fuel pump falls below a prescribed level to obtain a corrected pulse width, and applying pulses having the corrected pulse width to the fuel injector.

DESCRIPTION OF THE PREFERRED EMBODIMENT

Figure 1:
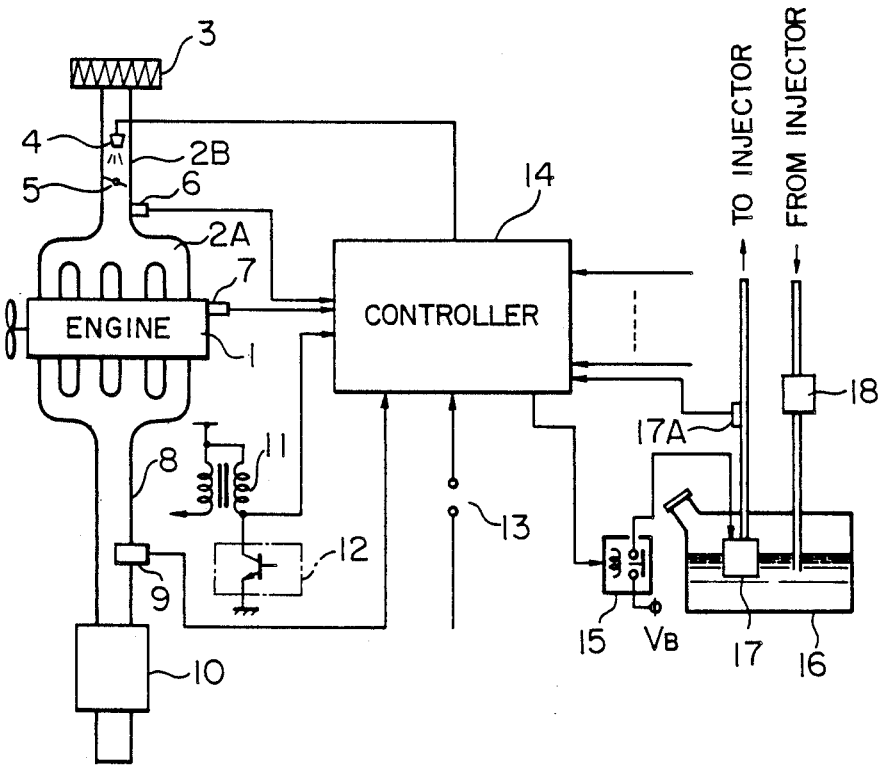
FIG. 1 is a schematic illustration of an embodiment of a fuel injector control apparatus in accordance with the present invention.

Next, a preferred embodiment of a fuel injector control apparatus according to the present invention will be described while referring to the accompanying drawings, FIG. 1 of which schematically illustrates an automotive engine to which this embodiment is applied. As shown in this figure, an intake manifold 2A is mounted on a conventional engine 1, and an air intake pipe 2B is connected to the upstream end of the intake manifold 2A. An air cleaner 3 is mounted on the upstream end of the air intake pipe 2B. A fuel injector 4 is mounted on the air intake pipe 2B so as to be able to spray fuel into the air intake pipe 2B. A throttle valve 5 is pivotally mounted inside the air intake pipe 2B downstream of the fuel injector 4. An air pressure sensor 6 which detects the absolute pressure P in the intake manifold 2B and produces a corresponding output signal is mounted on the air intake pipe 2B downstream of the throttle valve 5. A cooling water temperature sensor 7 which detects the cooling water temperature WT of the engine 1 and produces a corresponding output signal is mounted on the engine 1. The engine 1 is further equipped with an exhaust manifold 8 on which an air-fuel ratio sensor 9 is mounted. The air-fuel ratio sensor 9 detects the oxygen concentration of the exhaust gas from the engine 1 and produces a corresponding output signal. A catalytic converter 10 which employs a three-way catalyst to clean the exhaust gas is connected to the exhaust manifold 8 downstream of the air-fuel ratio sensor 9. Unillustrated spark plugs of the engine are energized by an ignition coil 11. The flow of current through the primary winding of the ignition coil 11 is turned on and off by an electronic igniter 12. An unillustrated starter of the engine 1 is switched on and off by a cranking switch 13. A fuel tank 16 which contains fuel for the engine 1 houses an in-tank fuel pump 17 such as a turbine-type pump. The discharge side of the fuel pump 17 is connected to the fuel injector 4 by piping, on the outside of which is mounted a fuel temperature sensor 17A which produces an output signal corresponding to the temperature $T_F$ of the fuel passing through the piping. The fuel pump 17 is powered by an unillustrated battery of the engine through a fuel pump relay 15. A fuel pressure regulator 18 which is connected between the fuel tank 16 and the fuel injector 4 adjusts the pressure of the fuel which is supplied to the fuel injector 4 so that it is a prescribed value, such as 2.55 kg/cm$^2$.

Figure 2:
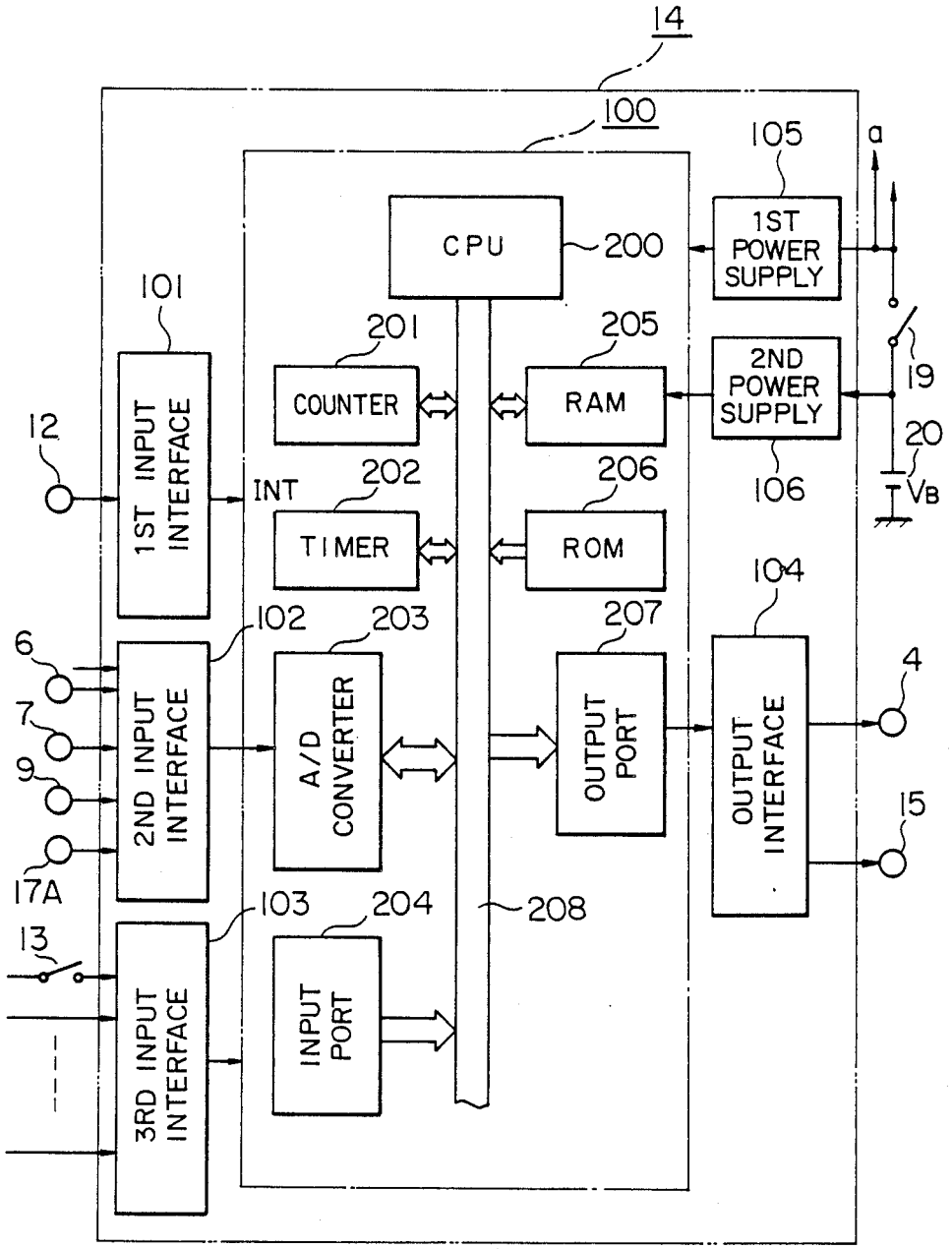
FIG. 2 is a block diagram of the controller of the embodiment of FIG. 1.

The output signals from the air pressure sensor 6, the cooling water temperature sensor 7, the air-fuel ratio sensor 9, and the fuel temperature sensor 17A are input to a controller 14. The voltage $V_B$ of a battery 20 is also input to the controller 14 via an ignition switch 19 (FIG. 2). Based on these and other inputs, the controller 14 calculates the width of electrical pulses to be applied to the fuel injector 4 and then applies these pulses to the fuel injector 4. The controller 14 also turns the fuel pump 17 on and off through the fuel pump relay 15.

Figure 5:
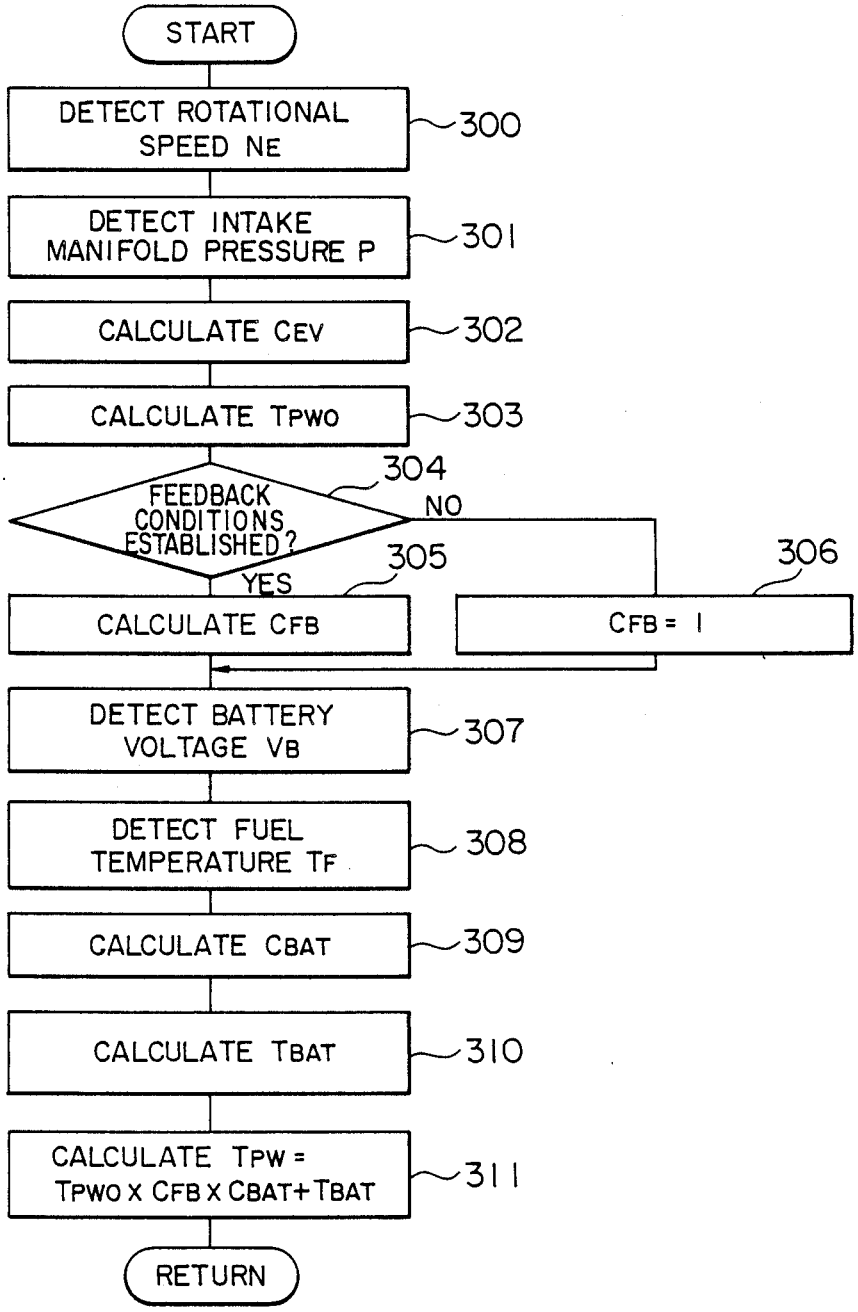
FIG. 5 is flow chart of a first mode of operation of the controller of FIG. 1 during an interrupt routine.

FIG. 2 schematically illustrates the structure of the controller 14. It has a microcomputer 100 which includes elements numbers 200–208. A CPU 200 that performs the operations shown in the flow chart of FIG. 5 is connected to a counter 201, a timer 202, an A/D converter 203, an input port 204, a RAM 205, a ROM 206, and an output port 207 by a common bus 208. The timer 202 measures the period of rotation of the engine 1. The RAM 205 functions as a work area, and the ROM 206 stores data for calculations and the program shown in FIG. 5.

The igniter 12 is connected to a first input interface circuit 101 of the controller 14. Each time the igniter 12 activates the ignition coil 11, a signal is input from the igniter 12 to the first input interface circuit 101, and the first input interface circuit 101 transmits this signal to the timer 202 as an interrupt signal.

A second input interface circuit 102 is connected between the A/D converter 203 and the air pressure sensor 6, the cooling water temperature sensor 7, the air-fuel ratio sensor 9, and the fuel temperature sensor 17A. It is also connected to the battery 20 of the engine through the ignition switch 19. The second input interface circuit 102 sequentially provides the input signals from the sensors to the A/D converter 203, which converts these input signals into digital signals and transmits them to the CPU 200. A third input interface circuit 103 is connected between the input port 204, the cranking switch 13, and other input lines. An output interface circuit 104 is connected between the output port 207 and both the fuel injector 4 and the fuel pump relay 15. The output interface circuit 104 generates output signals which turn the fuel injector 4 and the fuel pump relay 15 on and off. The width of the pulses which are applied to the fuel injector 4 by the output interface circuit 104 determine the amount of fuel which the fuel injector 4 discharges each time is it turned on.

Power is supplied to the microcomputer 100 by a first power supply 105 and a second power supply 106. The first power supply 105 is connected to the battery 20 through the ignition switch 19, while the second power supply 106 is connected directly between the battery 20 and the RAM 205 so that power is supplied to the RAM 205 even when the ignition switch 19 is open. The other portions of the microcomputer 100 receive power only when the ignition switch 19 is closed.

Figure 3:
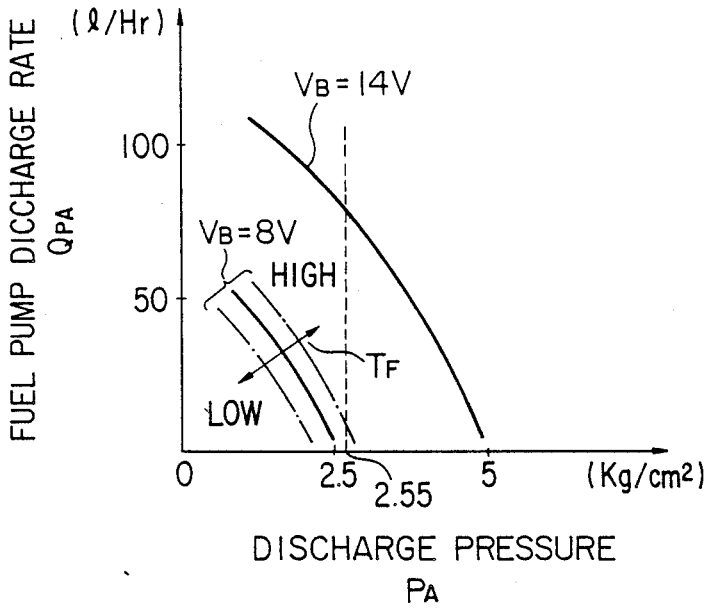
FIG. 3 is graph of the relationship between the fuel discharge rate and the discharge pressure of a fuel pump for different voltages of the battery which powers the pump.

FIG. 3 illustrates the output characteristics of the fuel pump 17, the abscissa being the discharge pressure of the pump 17 and the ordinate being the discharge rate. The voltage $V_B$ of the battery 20 and the fuel temperature $T_F$ are used as parameters. At a constant voltage $V_B$ and fuel temperature $T_F$, there is an inverse relationship between the discharge rate $Q_{PA}$ and the discharge pressure $P_A$. At a constant fuel temperature $T_F$, the curve for the relationship shifts to the right in the figure as the voltage $V_B$ increases, and at a constant voltage $V_B$, the curve shifts to the right as the fuel temperature $T_F$ increases. When the voltage $V_B$ and the fuel temperature $T_F$ are such that the discharge pressure $P_A$ falls below a normal level of 2.55 kg/cm$^2$, it is necessary to compensate for the drop in fuel pressure so as to maintain a correct supply of fuel to the engine.

Figure 4:
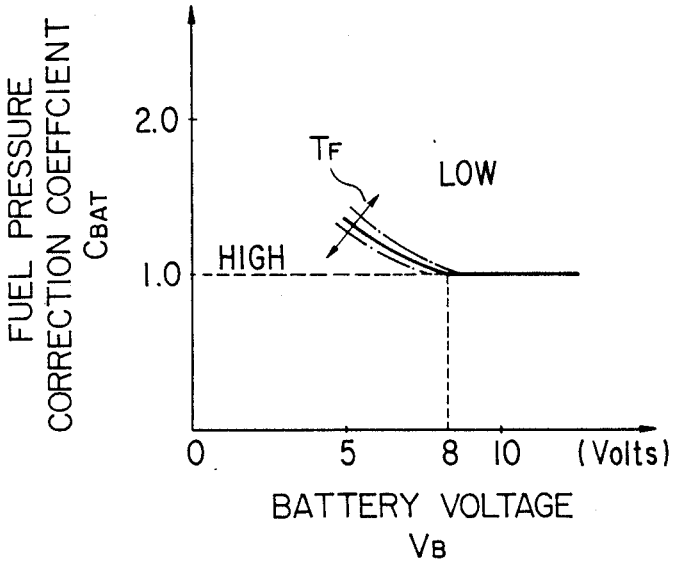
FIG. 4 is a graph of the relationship between a fuel pressure correction coefficient and battery voltage for different fuel temperatures.

In the present invention, this compensation for a drop in fuel pressure is accomplished by increasing the pulse width of the pulses which are applied to the fuel injector 4. Specifically, a basic pulse width $T_{PWO}$, which is calculated on the basis of engine operating parameters, is multiplied by a fuel pressure correction coefficient $C_{BAT}$ to give a corrected pulse width. In one form of the present invention, the fuel pressure correction coefficient $C_{BAT}$ is a function of the battery voltage $V_B$ and the fuel temperature $T_F$. FIG. 4 illustrates the relationship between the fuel pressure correction coefficient $C_{BAT}$ and the battery voltage $V_B$ with the fuel temperature $T_F$ as a parameter. When the battery voltage $V_B$ and the fuel temperature $T_F$ have values such that the pump discharge pressure $P_A$ is at least a prescribed minimum value, such as 2.55 kg/cm$^2$, the fuel pressure correction coefficient $C_{BAT}$ is equal to 1.0. However, when the voltage $V_B$ and the fuel temperature $T_F$ have values such that the pump discharge pressure $P_A$ falls below 2.55 kg/cm$^2$, the fuel pressure correction coefficient $C_{BAT}$ has a value of greater than 1.0 so that the corrected pulse width will be greater than the basic pulse width $T_{PWO}$. The value of $C_{BAT}$ increases as either the battery voltage $V_{BAT}$ or the fuel temperature $T_F$ falls.

The relationship shown in FIG. 4 is stored in the ROM 206 in the form of a table which gives the value of $C_{BAT}$ as a function of the battery voltage $V_B$ and the fuel temperature $T_F$. The inverse relationship between an injector voltage correction term $T_{BAT}$, to be described below, and the battery voltage $V_B$ is also stored in the ROM 206 in the form of a table.

The operation of the embodiment of FIGS. 1 and 2 will now be described. When the ignition switch 19 is turned on, electrical power is supplied to the controller 14 by the battery 20 and the controller 14 starts to operate. Subsequently, the cranking switch 13 is closed and the engine 1 is started. At this time, the controller 14 turns the fuel pump relay 15 on, whereby the battery voltage $V_B$ is applied to the fuel pump 17, which begins to run. The fuel pump 17 pumps fuel from the fuel tank 16 to the fuel injector 4, and the fuel pressure is maintained at a prescribed level, such as 2.55 kg/cm$^2$, by the fuel pressure regulator 18 as long as the battery voltage $V_B$ and the fuel temperature $T_F$ are such that the pump discharge pressure is at least the prescribed pressure of 2.55 kg/cm$^2$. However, when the battery voltage or the fuel temperature fall below certain levels, the fuel discharge pressure $P_A$ falls below 2.55 kg/cm$^2$, and the fuel pressure regulator 18 can not maintain the fuel pressure at the prescribed pressure of 2.55 kg/cm$^2$.

The controller 14 applies pulses having a prescribed pulse width to the fuel injector 4, and the fuel injector 4 sprays fuel into the air intake pipe 2B. As described above, when the fuel pressure falls below 2.55 kg/cm$^2$, the controller 14 compensates for the decrease in pressure by increasing the pulse width so as to lengthen the time for which the fuel injector 4 is open each time it discharges.

The fuel which is sprayed from the fuel injector 4 is sucked into the engine 1 together with intake air which enters the air intake pipe 2B through the air cleaner 3. The engine 1 is ignited by turning the igniter 12 from on to off, and the resulting high voltage which is generated in the ignition coil 11 is applied to the unillustrated spark plugs of the engine 1. The engine 1 generates power in a conventional manner by repeated combustion and compression. Exhaust gas from the engine 1 passes through the exhaust manifold 8, is cleaned by the catalytic converter 10, and is discharged into the atmosphere.

Next, the operation of the CPU 200 of the controller 14 will be described. First, when the ignition switch 19 is closed, the battery voltage $V_B$ is applied to the first power supply 105 by the battery 20, and the first power supply 105 supplies a constant voltage to the microcomputer 100. As a result, the controller 14 begins to operate. Next, when the cranking switch 13 is closed and an on signal is input to the CPU 200 via the third input interface circuit 103 and the input port 204, the controller 14 turns the fuel pump relay 15 on through the output port 207 and the output interface circuit 104. An interrupt signal is input from the timer 202 at prescribed intervals. Each time the interrupt signal is input, the CPU 200 initiates a routine for determining the pulse width of pulses which are applied to the fuel injector 4.

FIG. 5 is a flow chart of one example of this routine. In this example, the pulse width of pulses which are applied to the fuel injector 4 are corrected for both the battery voltage $V_B$ and the fuel temperature $T_F$. First, in Step 300, the rotational speed NE of the engine 1 is calculated based on an output signal from the timer 202, which measures the period of rotation of the engine 1. Namely, the timer 202 measures the length of time between two successive ignitions of the engine 1, which is determined by the length of time between two successive changes in the igniter 12 from on to off. The period which is determined by the timer 202 is stored in the RAM 205 by an unillustrated routine. The calculated value for the rotational speed NE is stored in the RAM 205.

Next, in Step 301, a signal from the air pressure sensor 6 which indicates the intake manifold pressure P is input to the CPU 200 via the second input interface circuit 102 and the A/D converter 203 and is stored in the RAM 205.

In Step 302, based on the data indicating the rotational speed NE and the intake manifold pressure P which are stored in the RAM 205, the CPU 200 calculates the volumetric efficiency $C_{EV}$ of the engine 1 based on an experimentally- determined relationship between the volumetric efficiency $C_{EV}$, the rotational speed NE, and the intake manifold pressure P, the relationship being stored in the ROM 206. The calculated value of the volumetric efficiency $C_{EV}$ is then stored in the RAM 205.

In Step 303, the basic pulse width $T_{PWO}$ is calculated. The basic pulse width $T_{PWO}$ is the basic length of each pulse applied to the fuel injector 4 prior to correction and is calculated as K (a coefficient) x P (intake manifold pressure,) x $C_{EV}$ (volumetric efficiency). The result is stored in the RAM 205. The value of K in the above equation is read from the ROM 206.

In Step 304, it is determined whether feedback conditions for the air-fuel ratio exist. This is determined by detecting whether the air-fuel ratio sensor 9 is activated, i.e., whether the output signal of the air-fuel ratio sensor 9 changes within a prescribed length of time. It is also possible to make this determination o the basis of other parameters, such as the cooling water temperature WT as indicated by the cooling water temperature sensor 7.

Figure 7:
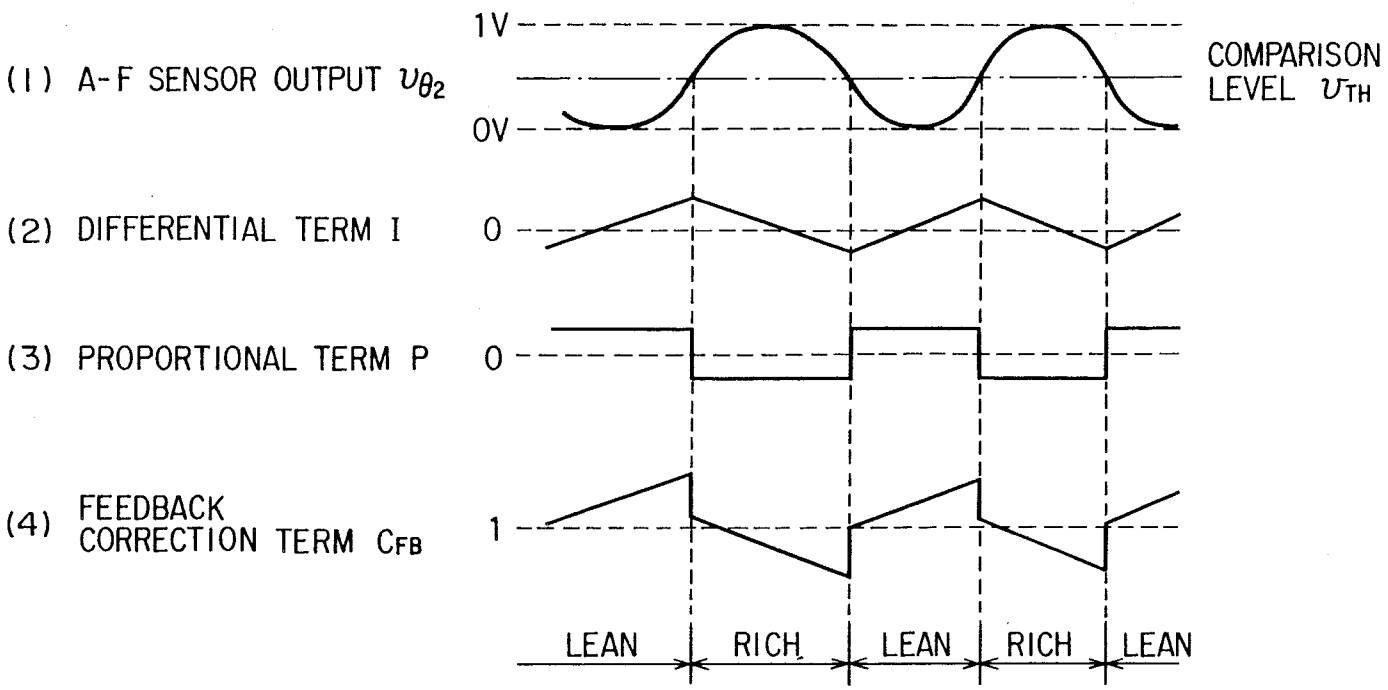
FIG. 7 shows waveforms involved in calculating feedback correction term during the routines of FIGS. 5 and 6.

If it is determined in Step 304 that feedback conditions have been established, then the routine proceeds to Step 305 in which a feedback correction term $C_{FB}$ for the fuel injection time is calculated by proportional-plus-integral control in accordance with the output of the air-fuel ratio sensor 9. The calculated result is stored in the RAM 205. In this connection, the feedback correction term CFB is calculated, for example, by the following formula:

$$C_{FB}=1+I+P$$

where I is a differential term which is a differential function of the fuel-air ratio sensor output $v_{\theta 2}$, and P is a proportional term. As shown in FIG. 7, the output $v_{\theta 2}$ of the air-fuel ratio sensor is a sinusoidal curve which alternately changes below and above a predetermined comparison level $v_{TH}$, (i.e., a stoichiometric air-fuel ratio) between a maximum of 1 V and a minimum of OV, as indicated by (1). The differential term I is calculated by differentiating the air-fuel sensor output $v_{\theta 2}$ and takes a repeated angular shape, as shown by (2) in FIG. 7. The proportional term P is of a rectangular wave form which alternately takes a predetermined positive value when the air-fuel ratio of the mixture is below the comparison or stoichiometric level, i.e., $v_{\theta 2} < v_{TH}$, and a predetermined negative value when the air-fuel ratio of the mixture is above the comparison or stoichiometric level, i.e., $v_{\theta 2} > v_{TH}$, as indicated by (3) in FIG. 7. Thus, the feedback correction term $C_{FB}$ is the sum of 1, the differential term I and the proportional term P and shown by (4) in FIG. 7.

If it is determined in Step 304 that feedback conditions have not been established, the routine proceeds to Step 306, and the feedback correction term $C_{FB}$ is set equal to 1 and stored in the RAM 205.

After Step 305 or Step 306, Step 307 is performed. In Step 307, a signal corresponding to the battery volta $V_B$ is input via the second input interface circuit 102 and the A/D converter 203, and the value of the battery voltage is stored in the RAM 205.

In Step 308, the signal from the fuel temperature sensor 17A which corresponds to the fuel temperature $T_F$ is input via the second input interface circuit 102 and the A/D converter 203, and the value of the fuel temperature $T_F$ is stored in the RAM 205.

Next, in Step 309, based on the values of the battery voltage $V_B$ and the fuel temperature $T_F$ which were stored in the RAM 205, the fuel pressure correction coefficient $C_{BAT}$ is read from the table in the ROM 206 and is stored in the RAM 205.

In Step 310, based on the value of the battery voltage $V_B$, the injector voltage correction term $T_{BAT}$ is read from the corresponding table in the ROM 206 and is stored in the RAM 205. The injector voltage correction term $T_{BAT}$ is used to compensate for the response delay of the fuel injector 4 due to the battery voltage.

In Step 311, the corrected pulse width $T_{PW}$ of pulses to be applied to the fuel injector 4 is calculated using the formula $T_{PW} = T_{PWO}$ (basic pulse width) $\times C_{FB}$ (feedback correction coefficient) $\times C_{BAT}$ (fuel pressure correction coefficient) $+ T_{BAT}$ (injector voltage correction term), and the result is stored in the RAM 205. The values of $T_{PW}$, $C_{FB}$, $C_{BAT}$ and $T_{BAT}$ are read from the RAM 205. Upon the completion of Step 311, the routine of FIG. 5 is completed, and an unillustrated main program is returned to.

The controller 14 then sends pulses having the calculated pulse width $T_{PW}$ to the fuel injector 4. The pulse width $T_{PW}$ is long enough to compensate for the decrease in the fuel pump discharge pressure $P_A$ caused by a decrease in the battery voltage $V_B$ or the fuel temperature $T_F$, so the proper quantity of fuel can always be supplied to the engine 1 by the fuel injector 4.

Figure 6:
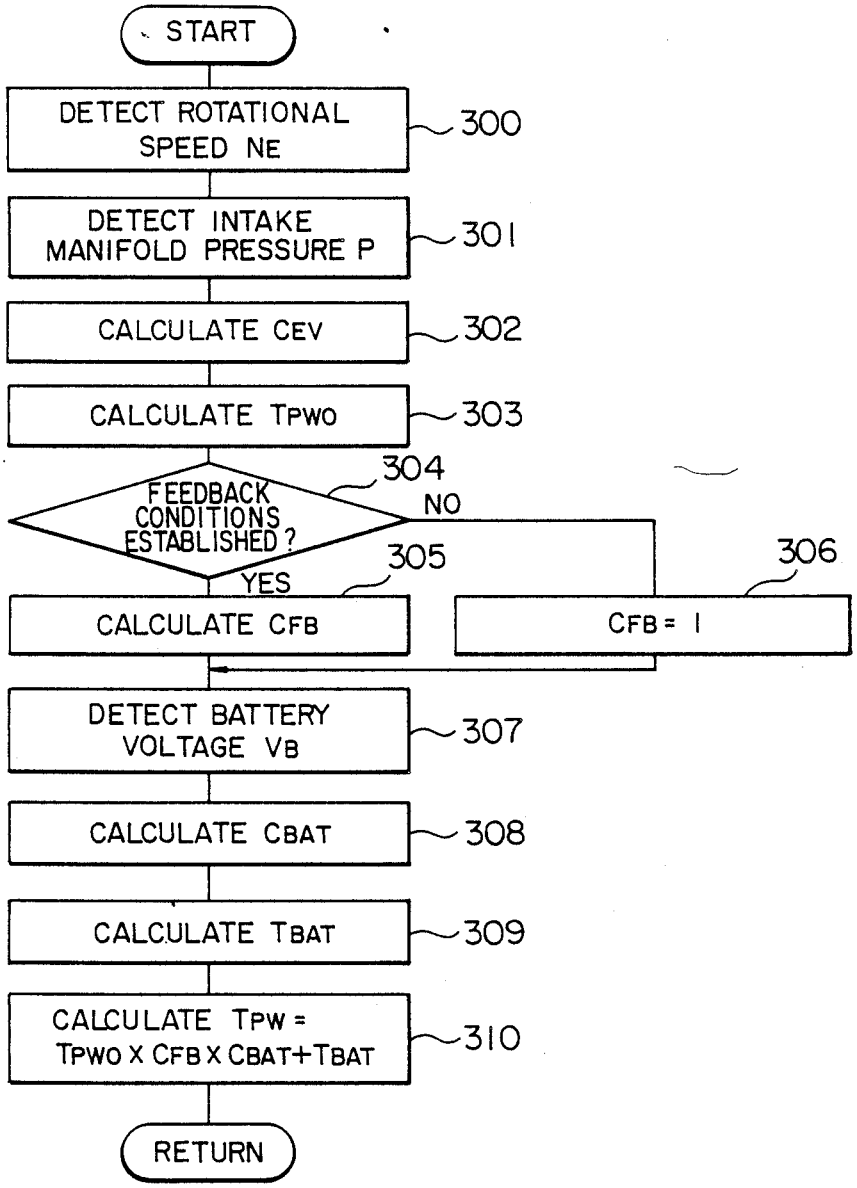
FIG. 6 is a flow chart of a second mode of operation of the controller of FIG. 1 during an interrupt routine.

In the example of a routine illustrated in FIG. 5, the pulse width is corrected in accordance with both the battery voltage $V_B$ and the fuel temperature $T_F$. FIG. 6 illustrates another example of a routine in which the pulse width is corrected only in accordance with the battery voltage $V_B$. Steps 300 through 307 of this routine are identical to the corresponding steps in FIG. 5. However, in Step 308, the fuel pressure correction coefficient $C_{BAT}$ is calculated only on the basis of the battery voltage $V_B$. Subsequent Steps 309 and 310 are identical to Steps 310 and 311, respectively, of FIG. 5.

The value of $C_{BAT}$ can be determined in Step 308 using the same table relating $C_{BAT}$ to the battery voltage $V_B$ and the fuel temperature $T_F$ as was used for the routine of FIG. 5 by assuming some constant value for the fuel temperature $T_F$. Alternatively, it is possible to store in the ROM 206 a table which gives the relationship between $C_{BAT}$ and the battery voltage $V_B$ at a single, typical fuel temperature $T_F$. If operation is performed in accordance with the example of FIG. 6, as the fuel temperature $T_F$ is not employed to determine the pulse width, it is possible to dispense with the fuel temperature sensor 17A.

In the examples of interrupt routines shown in FIG. 5 and FIG. 6, the value of $C_{BAT}$ is read from a table which is stored in the ROM 206. However, it is instead possible for the CPU 200 to determine the value of $C_{BAT}$ by calculating the value of a previously-determined function $C_{BAT} = f(V_B, T_F)$ in the case of FIG. 5 or $C_{BAT} = f(V_B)$ in the case of FIG. 6. The value of $T_{BAT}$ can also be calculated by the CPU 200 instead of being found from a table in the ROM 206.

In the examples described above, the interrupt routine is performed at prescribed intervals, but it is instead possible to perform the routine upon every revolution of the engine.

In addition, it is possible to calculate the fuel pressure correction coefficient $C_{BAT}$ as the product of a first fuel pressure correction coefficient $C_{FP}$ which is a function of the battery voltage $V_B$ and a second fuel pressure correction coefficient $C_{FT}$ which is a function of the fuel temperature $T_F$. Namely, $C_{FP}$ and $C_{FT}$ can be separately determined, and then $C_{BAT}$ can be found by the equation $C_{BAT} = C_{FP} \times C_{FT}$, wherein the product $\geqq 1$.

What is claimed is:

1. A control apparatus for a fuel injector for an engine comprising:

first sensing means for sensing operating parameters of an engine including rotational speed and intake manifold pressure;

calculating means responsive to said sensing means for calculating a basic pulse width of pulses to be applied to a fuel injector of the engine;

second sensing means for sensing at least one fuel pump operating parameter which influences the discharge pressure of an electric fuel pump disposed inside a fuel tank, which supplies fuel to the fuel injector and which is powered by a battery, said at least one fuel pump operating parameter including the voltage of the battery;

correcting means responsive to said second sensing means for lengthening the basic pulse width and producing a corrected pulse width when a sensed fuel pump operating parameter falls below a level which causes the discharge pressure of the fuel pump and attendantly the discharge rate thereof to fall below a prescribed level, the corrected pulse width being long enough to compensate for the decrease in discharge rate; and means for applying pulses having the corrected pulse width to the fuel injector.

2. A control apparatus as claimed in claim 1 wherein said second sensing means comprises means for sensing the voltage of the battery and the temperature of the fuel which is supplied to the fuel injector by the fuel pump.

3. A method for controlling a fuel injector of an engine comprising:

sensing operating parameters of an engine including rotational speed and intake manifold pressure;

calculating a basic pulse width of pulses to be applied to the fuel injector based on the sensed engine operating parameters;

sensing at least one fuel pump operating parameter which influences the discharge pressure of an electric fuel pump disposed inside a fuel tank and which supplies fuel to the fuel injector, said at least one fuel pump operating parameter including the voltage of a battery which powers the fuel pump;

lengthening the calculated basic pulse width when the value of a sensed fuel pump operating parameter falls below a level at which the discharge pressure of the fuel pump and attendantly the discharge rate thereof falls below a prescribed level to obtain a corrected pulse width which is long enough to compensate for the decrease in discharge rate; and applying pulses having the corrected pulse width to the fuel injector.

4. A method as claimed in claim 3 wherein sensed fuel pump operating parameters are the battery voltage and the temperature of the fuel which is supplied to the fuel injector.

* * * * *